United States Patent [19]

Lugo

[11] Patent Number: 4,669,609

[45] Date of Patent: Jun. 2, 1987

[54] TRAY FOR WALLPAPER ADHESIVE AND TOOLS

[76] Inventor: Jose R. Lugo, 835 Cross Ave., Elizabeth, N.J. 07208

[21] Appl. No.: 869,652

[22] Filed: Jun. 2, 1986

[51] Int. Cl.[4] ..... B44D 3/12; B65D 81/00

[52] U.S. Cl. ..... 206/229; 15/257.06; 206/223

[58] Field of Search ..... 15/104 R, 257.06; 206/229, 223

[56] References Cited

U.S. PATENT DOCUMENTS

| | | | |
|---|---|---|---|
| 1,595,965 | 8/1926 | Johnson | 15/104 R |
| 2,204,190 | 6/1940 | Siegel | 15/257.06 |
| 2,909,797 | 10/1959 | White | 15/257.06 |
| 3,087,190 | 4/1963 | Werner | 15/257.06 |
| 3,110,921 | 11/1963 | Conner | 15/257.06 |
| 3,707,242 | 12/1972 | Golden et al. | 15/257.06 |
| 3,837,034 | 9/1974 | Leffert et al. | 15/257.06 |
| 4,547,926 | 10/1985 | Kern | 15/257.06 |

FOREIGN PATENT DOCUMENTS

| | | | |
|---|---|---|---|
| 0234635 | 7/1961 | Australia | 15/257.06 |
| 1093203 | 11/1954 | France | 15/257.06 |

*Primary Examiner*—William Price
*Assistant Examiner*—Jimmy G. Foster

[57] ABSTRACT

This tray is designed to hold wallpaper adhesive or paint, and tools. Primarily, it consists of a body having a sump in it for containing the adhesive and a pair of legs are provided to maintain the tray level when it rests on a surface or ladder. It is further provided with compartments that receive tools and a hinged cover is also provided for covering the compartments.

2 Claims, 6 Drawing Figures

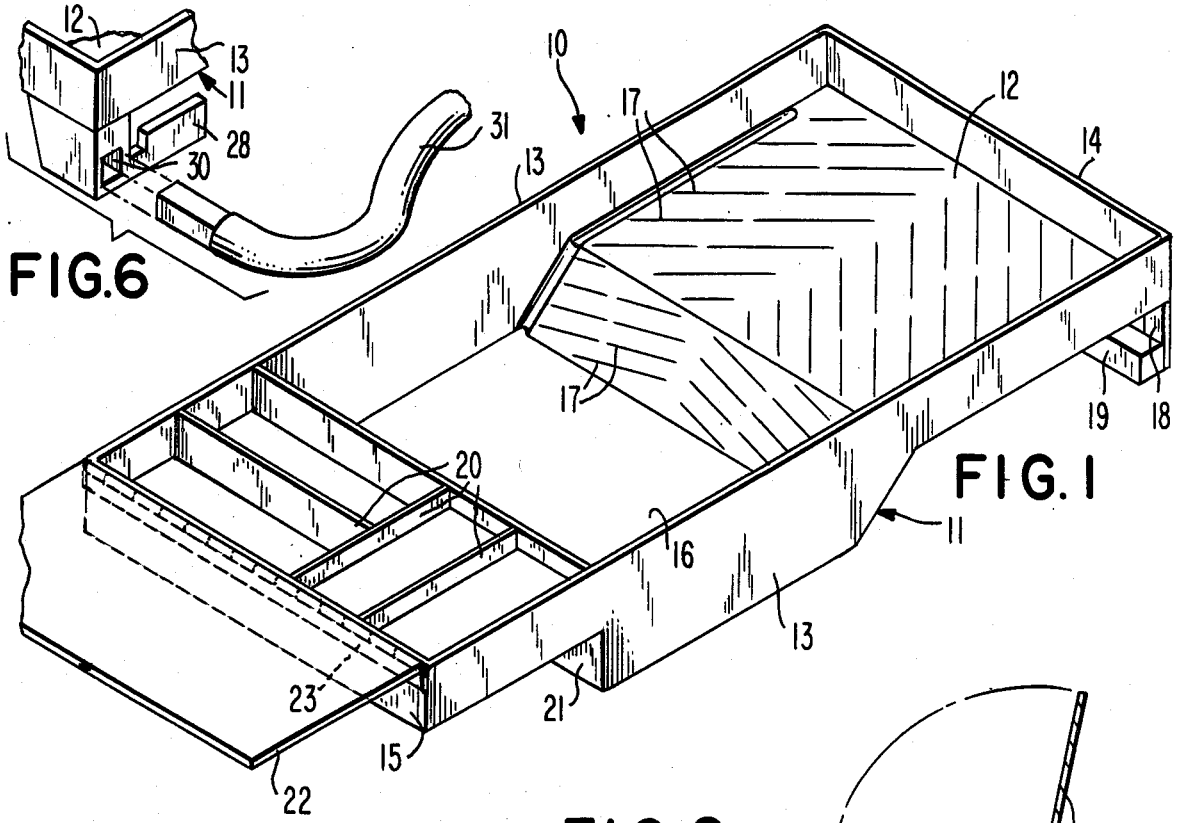
FIG.6
FIG.1
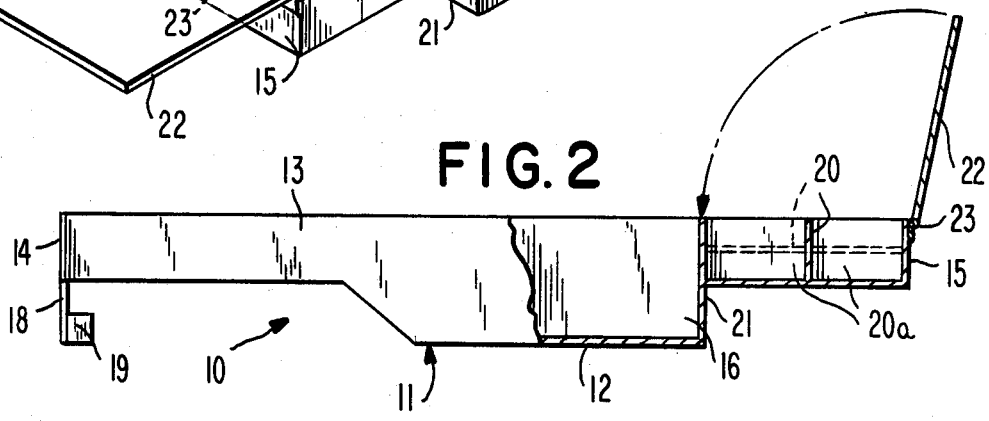
FIG.2
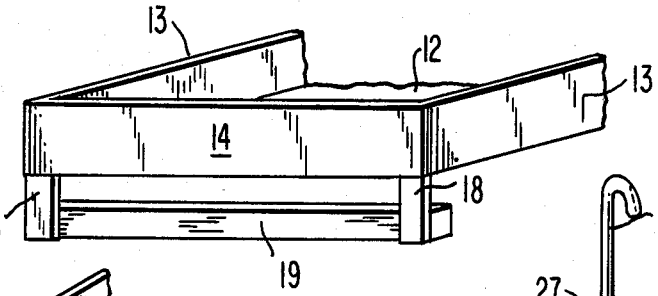
FIG.3
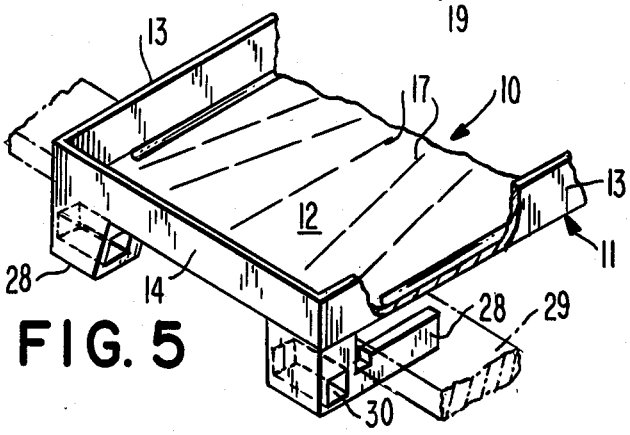
FIG.5
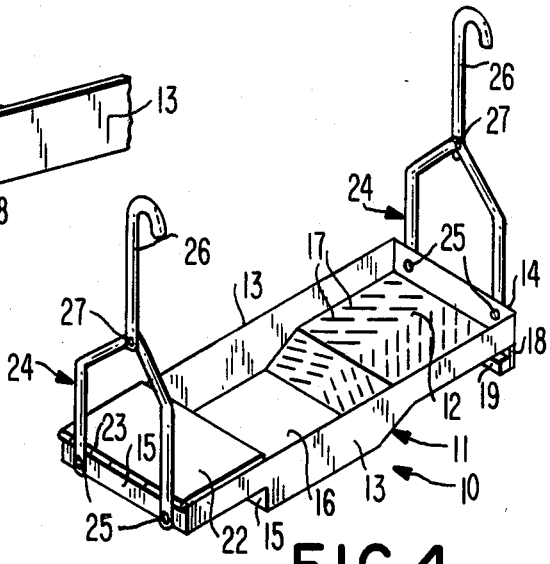
FIG.4

TRAY FOR WALLPAPER ADHESIVE AND TOOLS

BACKGROUND OF THE INVENTION

1. Field of the Invention

This invention relates to devices for interior decorators, and more particularly, to a tray for wallpaper adhesive and tools.

2. Description of Prior Art

Trays have been devised for tradesmen and are of various types. The tray in accordance with the present invention, is designed to be an aid to wallpaperer's, by being of such structure, as to hold adhesive or paint, a roller, other tools, razor blades, etc.

The principal object of this invention is to provide a tray for wallpaper adhesive and tools, which will have compartments therein, and the design will also include cover means for the compartments that retain a roller, razor blades and used razor blades that are employed in trimming wallpaper, and other tools.

Another object of this invention is to provide a tray for wallpaper adhesive and tools, which will also include ridges in the adhesive or paint tray, for removing excess adhesive or paint from the roller or a brush.

BRIEF DESCRIPTION OF THE DRAWINGS

FIG. 1 is a perspective view of the present invention;

FIG. 2 is an opposite side view of FIG. 1, shown in elevation and partly in section;

FIG. 3 is a fragmentary perspective view, illustrating the legs of the invention;

FIG. 4 is a perspective view of a modified form of the invention;

FIG. 5 is a fragmentary perspective view of another modified form of the invention, shown engaging a step of a step ladder which is shown in phantom lines and fragmentary, and FIG. 6 is a fragmentary perspective view of a further modified form of the invention.

SUMMARY OF THE INVENTION

A tray for wallpaper adhesive and tools, comprising a body having compartment means for receiving wallpaper adhesive or paint, and compartment means are provided for holding a roller, razor blades and other tools. The tray is further provided with a hinged cover for covering the compartments containing the roller, razor blades, etc.

DETAILED DESCRIPTION

Accordingly, a tray 10 is shown to include a body 11 having a bottom wall 12, a pair of side walls 13, and end walls 14 and 15. A sump 16 is formed in body 11 for receiving wallpaper adhesive, (not shown), and ribs 17 are provided on the top of the bottom wall 12, for removing excess adhesive from a roller or brush, (not shown). A pair of legs 18 are fixedly secured to bottom wall 12 beneath end wall 14, and a brace 19 is fixedly secured to legs 18 for strength and rigidity. A plurality of dividers 20 are secured fixedly to bottom wall 12 and the longitudinal dividers 20 are also fixedly secured to end wall 15 and sump wall 21, for defining compartments **20*a* for receiving a roller or brush, unused razor blades, used razor blades, and other tools. A pivotal cover 22 is provided for covering compartments 20*a* and is secured to a hinge 23 that is fastened to end wall 15**.

In use, tray 10 may be placed on a flat surface or it may be placed on a ladder, and the legs 18 serve as balance means therefor. The tools are placed in the compartments **20*a* as desired, and when using the adhesive placed in the sump 16, the compartments 20*a* are covered by closing the cover 22** over them.

Referring now to FIG. 4, tray 10 is modified to include a hanger member 24 on each end, held by fasteners 25 to the end walls 14 and 15. The hangers 24 are provided with a hook 26 which is secured to hangers 24 by pivot pins 27.

In use, the hooks 26 are employed on extension ladders and enable tray 10 to automatically pivot to level position.

Looking now at FIG. 5, tray 10 is again modified to include a pair of hooks 28 fixedly secured to bottom wall 12 at wall 14, for the engagement of a step 29 of a step ladder, (not shown).

In use, the hooks 28 slip onto the step 29 and firmly support tray 10 thereto.

Looking now at FIG. 6 of the drawing, the openings 30 in hooks 28 receive second hooks 31 removably, which provide a means of engaging the sides of a ladder.

While various changes may be made in the detail construction, such changes will be within the spirit and scope of the present invention, as defined by the appended claims.

What I now claim is:

1. A tray for holding wall paper adhesive or paint and for holding tools comprising:

(A) means forming said tray including a bottom wall and including side walls and end walls extending upwardly from the perimeter of said bottom wall, said tray having a wallpaper adhesive or paint holding compartment, having a plurality of tool storing compartments and having dividers for dividing said compartments, said dividers extending upwardly from the bottom wall and being located within the perimeter of said bottom wall, said wallpaper adhesive or paint holding compartment including a sump portion, said tool storing compartments being shallower than said sump portion, a portion of said bottom wall at said sump being at a location below the remainder of said bottom wall at said tool storing compartments;

(B) means for covering said tool storing compartments only, leaving said wallpaper adhesive or paint holding compartment open when said covering means is in a closed position, said covering means having a hinged connection to a top of one of said end walls;

(C) means for hookingly engaging said tray to a ladder comprising a pair of legs extending downwardly from the bottom wall at an end wall opposite said one end wall, said engaging means including a hook extending transversely from said legs and extending in a direction such that a space is provided between said hook and said bottom wall.

2. The tray as set forth in claim and also including a hole in each of said legs and including a side hook for each hole, each side hook having means to engage said hole.

* * * * *